US005173043A

United States Patent [19]

White, Jr.

[11] Patent Number: 5,173,043

[45] Date of Patent: Dec. 22, 1992

[54] REDUCED SIZE HYDRAULIC MOTOR

[75] Inventor: Hollis N. White, Jr., Hopkinsville, Ky.

[73] Assignee: White Hydraulics, Inc., Hopkinsville, Ky.

[21] Appl. No.: 777,435

[22] Filed: Oct. 11, 1991

Related U.S. Application Data

[63] Continuation of Ser. No. 471,475, Jan. 29, 1990, abandoned.

[51] Int. Cl.[5] ..... F03C 2/08

[52] U.S. Cl. ..... 418/61.3

[58] Field of Search ..... 418/61.3

[56] References Cited

U.S. PATENT DOCUMENTS

| | | | |
|---|---|---|---|
| 3,288,034 | 11/1966 | White, Jr. et al. | 418/61.3 |
| 3,381,498 | 5/1968 | McDermott | 418/61.3 |
| 3,452,680 | 7/1969 | White, Jr. | 418/61.3 |
| 3,627,454 | 12/1971 | Goff et al. | 418/61.3 |
| 3,825,376 | 7/1974 | Petersen et al. | 418/61.3 |
| 3,829,258 | 8/1974 | Easton | 418/61.3 |
| 3,873,248 | 3/1975 | Johnson | 418/61.3 |
| 4,232,708 | 11/1980 | Miller | 418/61.3 |
| 4,316,707 | 2/1982 | Hansen et al. | 418/61.3 |
| 4,474,544 | 10/1984 | White, Jr. | 418/61.3 |
| 4,533,302 | 8/1985 | Begley | 418/61.3 |
| 4,533,303 | 8/1985 | Petersen et al. | 418/61.3 |

FOREIGN PATENT DOCUMENTS

| | | | |
|---|---|---|---|
| 627231 | 9/1978 | U.S.S.R. | 418/61.3 |

*Primary Examiner*—John J. Vrablik

*Attorney, Agent, or Firm*—Woodling, Krost & Rust

[57] ABSTRACT

In a hydraulic motor having an orbiting valve, the improvement of the orbiting valve being connected to the wobble stick for rotation therewith and the orbiting valve being non-circular with a series of discreet valving openings and notches formed therein.

47 Claims, 5 Drawing Sheets

REDUCED SIZE HYDRAULIC MOTOR

This is a continuation of co-pending application Ser. No. 471,475 filed on Jan. 29, 1990, now abandoned.

This invention relates to a reduced sized hydraulic pressure device.

BACKGROUND OF THE INVENTION

Historically hydraulic pressure devices have been large, weighty units designed to provide low speed, high torque in applications remote from a central power source. The U.S. Pat. Nos. 3,606,601 and 4,697,997 are examples of these heavy duty hydraulic motors. These heavy duty hydraulic motors are of a significant size and weight. The size and weight limits the number of potential applications for the hydraulic pressure devices. This limits the utilization of such devices.

OBJECTS OF THE INVENTION

It is an object of this present invention to provide for a reduced size hydraulic motor.

It is an object of this invention to provide for a high torque device in a small package.

It is an object of this present invention to increase the potential applications for gerotor motors.

It is an object of this invention to reduce the cost of gerotor motors.

Other objects and a more complete understanding of the invention may be had by referring to the drawings in which:

DRAWINGS

FIG. 1 is a longitudinal cross sectional view of a pressure device incorporating the invention of the application;

FIG. 2 is a lateral cross sectional view of the port plate for the hydraulic device of FIG. 1;

FIG. 3 is a lateral cross sectional view of the first fluid passage plate of the device of FIG. 1;

FIG. 4 is a lateral cross sectional view of the second passage plate of the device of FIG. 1;

FIG. 5 is a lateral cross sectional view of the transfer plate of the device of FIG. 1;

FIG. 6 is a lateral cross sectional view of the commutation plate of the device of FIG. 1;

FIG. 7 is a lateral cross sectional view of the orbiting valve of the device of FIG. 1;

FIG. 8 is a lateral cross sectional view of the valving plate of the device of FIG. 1;

FIG. 9 is a lateral cross sectional view of the swirl plate of the device of FIG. 1;

FIG. 10 is a lateral cross sectional view of the opening plate of the device of FIG. 1;

FIG. 11 is a lateral cross sectional view of the gerotor structure of the device of FIG. 1;

FIG. 12 is a lateral cross sectional view of the mounting piece of the device of FIG. 1;

FIG. 13 is a lateral cross sectional view of the orbiting valve located on top of the commutation plate taken generally from line 13—13 in FIG. 1;

FIG. 14 is a view of the orbiting valve on top of the valving plate of FIG. 8 taken generally from line 14—14 in FIG. 1;

FIG. 15 is a view of the gerotor device on top of the cell opening plate of FIG. 10 taken generally from line 15—15 in FIG. 1;

FIG. 16 is a conceptual drawing detailing the cooperation and shape of the orbiting valve;

FIG. 17 is an enlarged drawing of a section of FIG. 16;

FIG. 18 is a drawing of a representational prior art orbiting valve;

FIG. 19 is a cross-sectional drawing of the wear plate 39; and,

FIG. 20 is a cross-sectional drawing of an alternate wobble stick having oversized teeth.

DESCRIPTION OF THE DRAWINGS

This invention relates to a reduced size pressure device. The invention will be described in its preferred embodiment of a gerotor motor having an orbiting valve separate from the rotor.

The gerotor motor 20 has a body including a port plate 22, first and second passage plates 23 and 24, a transfer plate 25, a commutation plate 26, an orbiting valve structure 27, a valving plate 28, a swirl plate 29, a cell opening plate 30, a gerotor structure 31, a mounting piece 32, a drive shaft 33, and a wobble stick 38.

Figure 1:
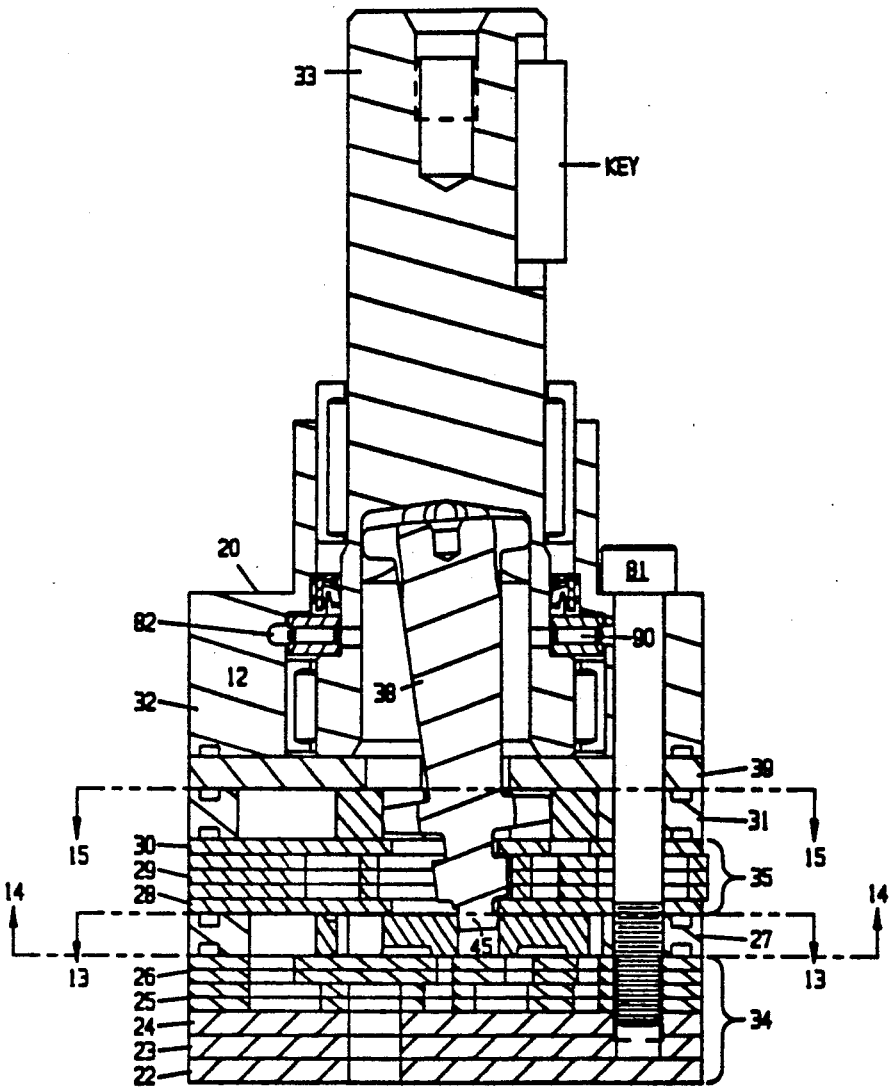

The port plate 22 interconnects the motor 20 to the pressure and return lines through ports 40, 41 and connects the interior of the motor 20 to a drain line via the port 42. The port plate 22 itself is brazed together with the two passage plates 23, 24, the transfer plate 25, and the commutation plate 26 in order to form an integral, single piece assembly 34. Small pins 43 through a series of three alignment holes 44 in each of this series of plates aligns the plates into their correct orientation in respect to the other plates in order to ease the assembly and brazing of this unit 34. An orientation bump 45 on each of the plates further facilitates the assembly process.

The port openings 40, 41 extend through the port plate 22, the first passage plate 23, and the second passage plate 24. These openings are tapped after the unit 34 is brazed together. This allows for a solid connection of the pressure and return lines for the gerotor device in a minimum space (i.e. not adding any longitudinal length). The case drain 42 likewise extends through all three plates and is tapped in a similar manner. The port plate and passage plate therefore together retain the fluid pressure, return, and drain lines to the motor 20. If desired another method of connecting these lines could also be utilized (such as additional already threaded external taps brazed directly into the untapped openings or otherwise).

The transfer plate 25 fluidically connects the ports 40, 41, 42 in the port plate 22 to the respective openings in the commutation plate 26. The passages in the transfer plate 25 accomplish this synergistically with the commutation passages in the commutation plate 26. The fluid from the port 41 interconnects with one of the passages 50 in the transfer plate 25. There are walls 53 between and around each of these passages 50 separating them from each other. The commutation passages 55 in the neighboring commutation plate 26 overlay the passages 50 in the transfer plate 25 so as to interconnect the otherwise separated passages 50 (and visa versa). The commutation passages 55 in the commutation plate allow fluid to pass between the passages 50 in the transfer plate 25 over the walls 53 and the passages 50 in the transfer plate 25 in turn allow fluid to bypass the walls 54 between the commutation passages 55 in the commutation plate 26. In a like manner the fluid from the port 40 interconnects to the passages 51 in the transfer plate 25. Again the wall portions 58 between the passages 51 in the transfer plate are bypassed by the commutation passages 56 in the commutation plate and the walls 59 in the commutation plate 26 are bypassed by the passages 51 in the transfer plate. The use of the passages in one plate to bypass walls between passages in another plate allows fluid to flow in a manner as if the walls were not there while also locating the passages (and other parts of the plates) into a reliable and predictable location. Thus the operation and construction of the device are both facilitated at the same time.

In addition to these synergistic overlaying passages, there is a passage 52 in the transfer plate which interconnects the drain port 42 to a hole 57 in the center of the commutation plate 26. This hole 57 interconnects to the interior of the motor 20 as later described. Note that the passages 50, 51, 52, 55, and 56 are located asymmetrically on the transfer plate and commutation plate. This asymmetric location or orientation allows for passages to occupy the same radial space as other passages in order to reduce the overall diameter of the device while providing at the same time for an efficient fluid transfer between these passages and operation of the device.

The commutation passages 55, 56 in the commutation plate 26 communicate at all times with the area 63 surrounding the orbiting valve 60 and a groove 65 cut on the back side of the orbiting valve 60 which groove is in turn interconnected to the four inner valving openings 61 for the device. This connection allows for communication of fluid from the ports 40, 41 to the two valving openings 61, 62 in the orbiting valve. In addition the central drive opening 64 of the orbiting valve 60 communicates with the hole 57 in order to connect such central drive opening 64 to the opening 57 in the commutation plate 26. This latter connection provides the fluidic transfer path for the case drain from the interior of the gerotor motor 20.

In the preferred embodiment fluid is fed into this interior in order to cool and lubricate the bearings and wobble stick drive interconnections. This fluid begins in the periodially pressurized swirls 71 in plate 29, travels down the bolt holes 80 (about the bolts 81) to a circular groove 82 cut into the interior of the mounting plate 32 radially outward of the main thrust bearings. As this fluid is pressurized (during the selective valving to the gerotor cells), the fluid then passes through the radial thrust bearing 90 into the interior of the mounting plate and eventually through the central drive opening 64 and the hole 57 to exit the device through port 42. (As the central drive opening 64 is held at a low pressure, there is no significant reverse flow back down the bolt holes 80 (via the particular swirl(s) connection to return instead of pressure.) If desired a separate valved flow of high pressure could be provided.

Figure 7:
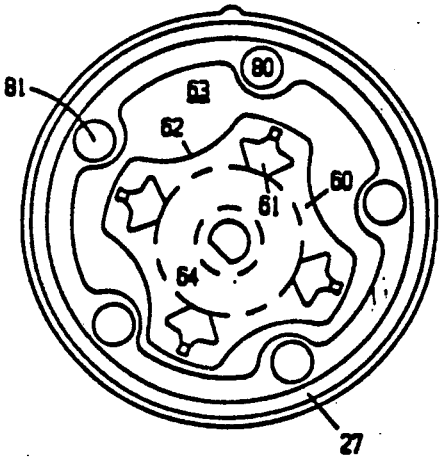
Figure 8:
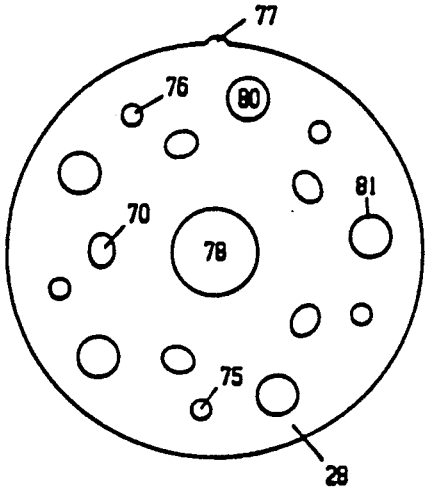
Figure 9:
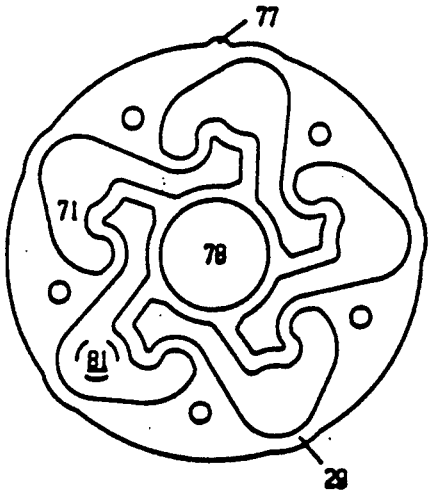
Figure 10:
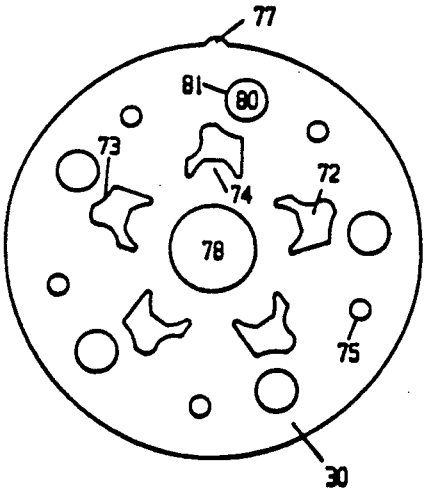
Figure 11:
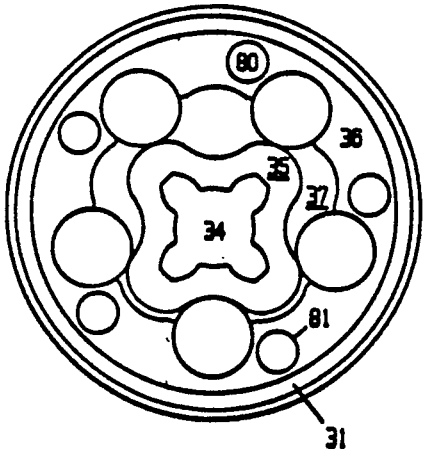
Figure 12:
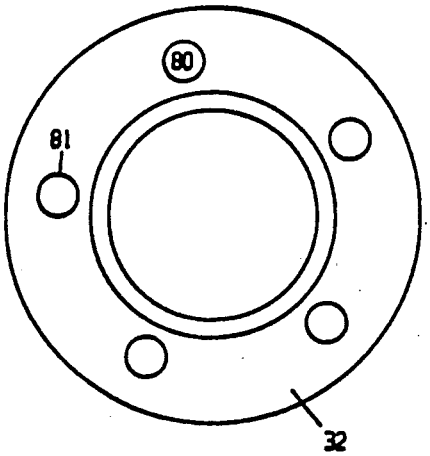

The orbiting valve 60 is the main operative valve for the gerotor motor 20. This orbiting valve 60 seen in FIG. 7 includes a series of four inner valving openings 61 and a series of four outer valving notches 62. These inner openings and valving notches cooperate with a series of five valving openings 70 in the valving plate 28 in order to valve the device. This four orbiting valving opening, five cell (and fewer openings/cells) device is the preferred environment for the invention.

Figure 18:
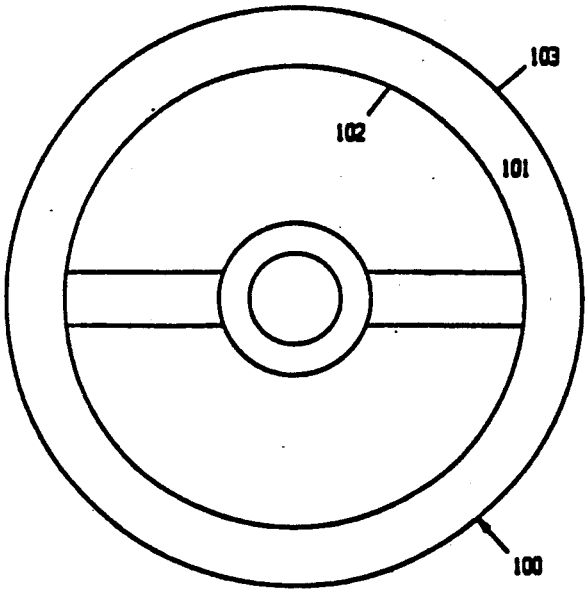
PRIOR ART FIG. 18

The shape and design of the orbiting valve 60 is unique. In a normal toe driven orbiting valve (similar to that shown in the U.S. Pat. No. 3,606,601), the orbiting valve 100 is circular in shape with even diameters throughout the valve and continuously extending valving openings (the inside 102 and outside 103 edges of the main valving section 101). The normal orbiting valve is also free to rotate in respect to the wobble stick. This is shown in representative form in FIG. 18.

Figure 16:
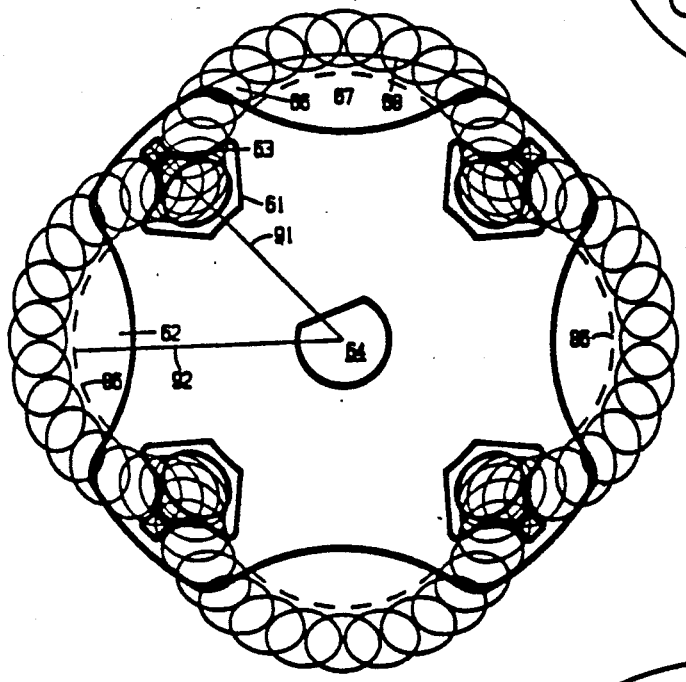
Figure 17:
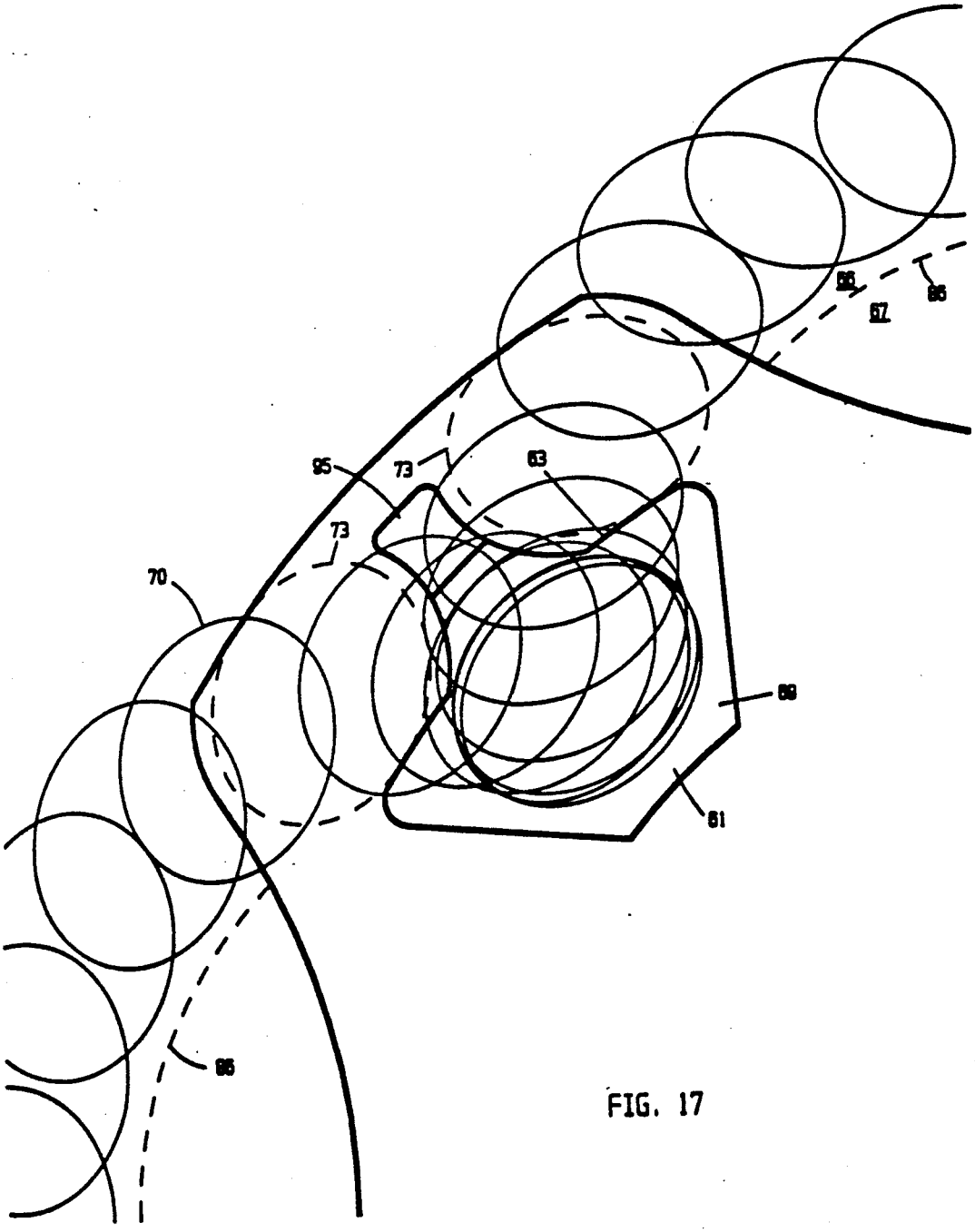

In contrast the preferred orbiting valve 60 of this application has a series of discreet hat shaped inner openings 61 and is connected to the wobble stick for rotation therewith. In addition, a series of discreet recessed notches 62 improves the outer opening valving operation. The shape of the openings 61 are determined by generating the path traced by a particular valving opening 70 in respect to a moving valve 60. (This design is what one would see the opening 70 follow if one was standing on the orbiting valve 60 during a 360° valving operation.) As shown in FIGS. 16 and 17 in the preferred embodiment disclosed, this design traced is a series of uniform arcs each terminating in substantially single inward positions. In addition, the hat shaped inner opening 61 is laid out in a pattern matching that followed by the valving opening 70 (instead of extending for 360° as in the representative orbiting valve of FIG. 18). The outermost extension 95 of the opening 61 (the top of the hat) is radially outward of that in an ordinary orbiting valve. This increases the surface area of valving fluid passages between the opening 61 and valving opening 70. Note that the main section 69 of the hat shaped opening 61 is slightly oversized in an inward and circumferential direction—i.e. bigger than the valving opening 70. This provides a measure of tolerance to the valving of the device. The curved cutouts 63 in the top of the openings 61 are designed so as to allow a minimal null position wherein the particular valving opening 70 is connected to neither the opening 61 or the notch 62 (null opening identified as the dotted lined opening 78 and opening 73 in FIG. 17). For clockwise rotation the null opening 78 is the null for the leading edge and the null opening 73 is the null for the lagging edge for a given hat shaped opening 61.

Figure 13:
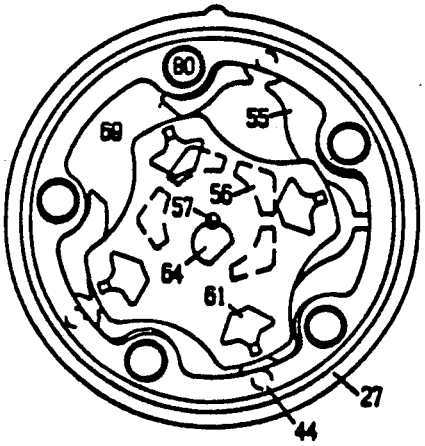
Figure 19:
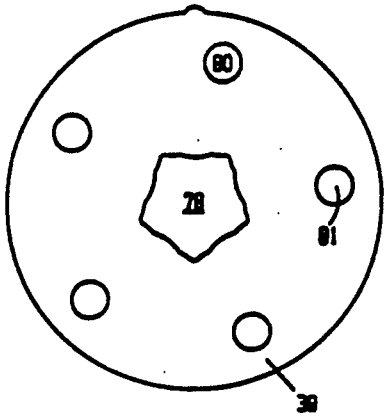

There is an increased spacing between the opening 70 with the opening 61 and the notch 62 in a diagonal direction as contrasted to that in a radial direction (i.e. almost no spacing in a radial direction with about three thousandths spacing in a diagonal direction). This increased spacing is designed to minimize direct leakage between the opening 61 and notch 62 by approximately equalizing both the radial and diagonal sealing time (as opposed to equalizing the radial and diagonal distances). Note that the inner openings 61 defined in FIGS. 16 and 17 are separately, individually located radially spaced about the parameter of the orbiting valve 60. It is preferred that a groove 65 on a surface of the valve 60 (preferably the backside) interconnect the openings 61 (groove 65 omitted in FIG. 13 for clarity). This groove increases the commutation fluid flow to the openings 61 by effectively combining their surface area for commutation. This is needed with the asymmetric commutation shown. With other types of commutation, the groove would be an added feature.

The notch 62 is cut inwardly into the outer circumference of the orbiting valve 60 for two reasons. The leading and trailing triangles 66 from what would otherwise be the outer circumference 68 of the valve 60 to the dashed lines 86 are cut into the circumference 68 of the valve 60 in order to improve the valving to the outermost valving opening. The inner crescent opening 67 is cut into the valve 60 from the outer circumference 68 to the dashed line 86 in order to create a clearance for the bolts 81 that hold the device together. This in combination with the valve 60 being keyed to the wobble stick allows the orbiting valve 60 to be oversized in respect to the remainder of the device. This facilitates the accuracy of the valving. The outside edge of the inner valving opening, the opening 61, extends for a certain distance 91 from the center of the valve 60, which distance 91 is more than the radial dimension of the certain distance 92 of the inside edge 86 of the outer valving opening, the opening 62.

Note that due to the shapes of the opening 61 and the notch 62 the valving opening 70 is connected to each for substantially the same length of time due to the circumferential extension of the opening 61 and notch 62 differing. This increases the smoothness of the power generated by the device.

The valving plate 28 cooperates with the swirl plate 29 and the cell opening plate 30 in order to accomplish the offset needed for the type of orbiting valving utilized in the gerotor motor. These three plates 28, 29, 30 are brazed together to form an integral assembly 35. In this assembly each hole 70 in the valving plate communicates through the swirl 71 in the swirl plate 29 to interconnect with a cell opening 72 in the cell opening plate 30. The number of these passages is equal to the number of gerotor cells in the gerotor device 31, in this case five in number. The shape of the openings 70 is unusual for their slightly elliptical shape. This shape allows one to maximize the radial valving dwell time while reducing the radial dimension of the device slightly more than an equivalent circle would do. The shape of the passages 71 in a swirl plate 29 are unusual in that these passages swirl outwards around the bolts 81 and then back inwardly to the approximate location of the cell openings 72 in the plate 30. The actual shape of these passages 71 are dictated more by the geometry of the valve 60 and the cell openings 72 than any other factor. In specific the ends of the passages 71 match the shapes of the valving openings 70 in the valving plate 28 and the cell opening 72 in the cell opening plate 30 with the length between these two ends being designed to have a minimum wall thickness between adjacent or overlaying passages. This allows one to maximize the fluid flow through these swirls 71 for the particular dimensions shown and described. The cell openings 72 in the cell opening plate 30 have a geometry largely dictated again by the remainder of the device. For example the outer edges 73 of the openings 72 are designed to allow the swirls 71 in plate 29 to bypass on the inside of the bolts through such plate. An additional example the inside 74 of the cell openings 72 are designed to allow for a clearance of the wobble stick drive on the inside of the rotor so as to insure a separation between the case drain and the openings 72. The width of the cell openings 72 are designed as a compromise between the desire to have the passages 71 as large as in cross section as possible while also insuring that there is a good flow path through such passages 72.

The plates 28, 29, 30 are connected into an assembly 35. As with the assembly 34 there are a series of locating pins 75 in a series of holes 76 in order to align these plates into position prior to and during brazing assembly. Again a nub 77 on the outside of the plates provides external verification that the plates are located in their proper orientation.

Figure 20:
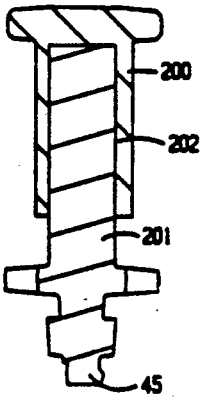

The gerotor device 31 is a relatively standard gerotor device with the exception of the fact the preferred rotor is driven by a heavy, equal number-toothed wobble stick 38 having teeth in alignment with the lobes of the rotor. The rotor lobes thus allow room for the teeth of the wobble stick without significant compromise. In the embodiment shown, the outside diameter about the rotor end teeth of the wobble stick is the maximum integral size that can fit through the circular drive hole in the wear plate. This diameter was determined in consideration primarily of the size of the circular hole, the thickness of the wear plate, the number of teeth, the root diameter of the teeth, and the thickness of the teeth. An alternate way of obtaining oversized teeth at the wobble stick rotor drive interconnection would be to use a two piece wobble stick (see for example FIG. 20—two piece construction 200, 201 with a multiple spline 202 interconnection). The alternate method would allow even larger teeth for the wobble stick rotor drive interconnection shown at a added materials-/assembly cost. In certain very high torque applications these even larger teeth would be beneficial. Other construction methods to allow oversized teeth could also be utilized as appropriate (multiple piece wear plates, laminated wear plates, pass through notches in the wear plate—later filled or unfilled, separate wobble stick teeth, etc.). In any event it is preferred that the maximum outside diameter about the wobble stick teeth be substantially equal to or greater than the root or minor diameter (minimum diameter) at the base of the rotor's lobes. This in combination with the fact that the wobble stick teeth are in alignment with the rotor lobes allows for a greater strength to the wobble stick construction rotor drive interconnection. The drive shaft end teeth of the wobble stick are similarly oversized. However there are fewer design constraints on these teeth than those in the rotor.

The rotor 35 of this gerotor device cooperates with the surrounding stator 36 in order to form expanding and contracting gerotor cells 37. The stator rollers 85 for the stator rotate on a thin film of oil to ease this operation. It is preferred that the rotor 35 be slightly oversized in respect to the geometry of the stator 36 so as to force these rolls outward during the operation of the gerotor device 31. This outward force increases the quality of the seal for the gerotor device and thus improves, the efficiency of such device. The openings in the center 78 of the rotor about the wobble stick 34 allow fluid from the interior of the gerotor device 20 to pass down the length of the opening 79 in the assembly 35 to interconnect to the openings about the valve drive 64 and thus interconnect to the hole 57 and port 42 in the port plate. This provides for a drain passage for the interior of the gerotor device 20 allowing the fluid therein to escape the device.

The mounting piece 32 is utilized to retain the gerotor motor 20 in operative position in respect to the device with which it will be utilized. A series of bolts 81 extend from this mounting piece through the gerotor structure 31, the assembly 35, and the valving plate to interconnect with the threaded holes in the assembly 34. This series of bolts 81 retains all of the pieces together to form the integral housing for the gerotor device 20. Due to the fact that the heads of the bolts 81 are recessed, mounting of the gerotor motor 20 is not compromised. If desired these bolts 81 could extend through the device 20 in the other direction with the threads in the mounting piece 32, be terminated differently (a nut) or otherwise modified to suit a particular application. Separately tapped holes extending between and parallel to the bolts 81 allow for the mounting of the particular motor shown. Other methods could also be utilized as appropriate.

The drive shaft 33 is the output for the gerotor device 20. In the preferred embodiment this drive shaft is of a significant diameter in respect to the size of the remainder of the gerotor device. This size is due to the recognition of the tremendous torque which is capable of being generated by this reduced size gerotor device as well as the five to one speed reduction inherent in the gerotor structure. If desired other forms of drive output could be utilized. An example of this would be to bolt the gerotor structure itself from the wear plate 39 through the port plate 22 directly onto the device being powered with the wobble stick 38 extending into the device to directly power an internally splined shaft for the device (instead of the intermediate drive shaft 33). The toe 45 of the wobble stick 38 is drivingly non-rotatively connected to the valve 60 at the central drive opening 64 thereof.

Figure 14:
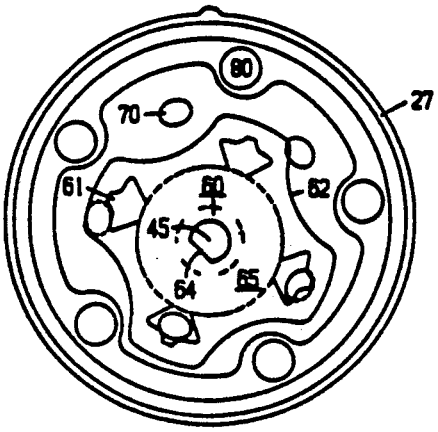
Figure 15:
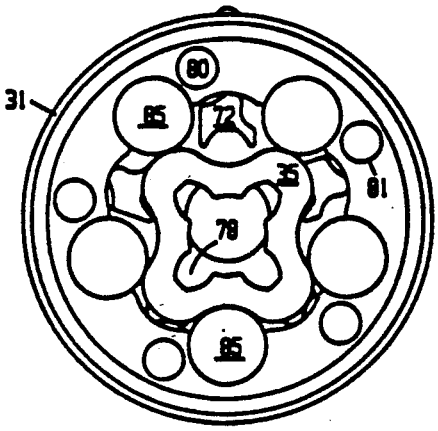
Figure 2:
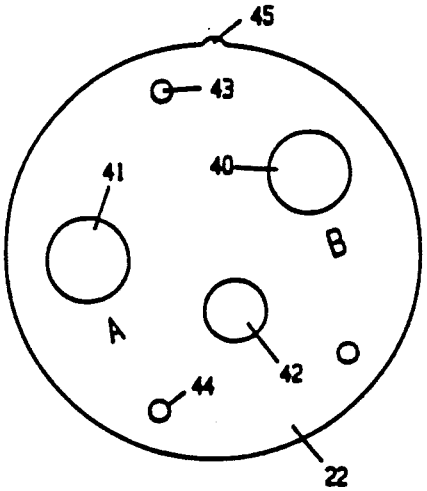
Figure 3:
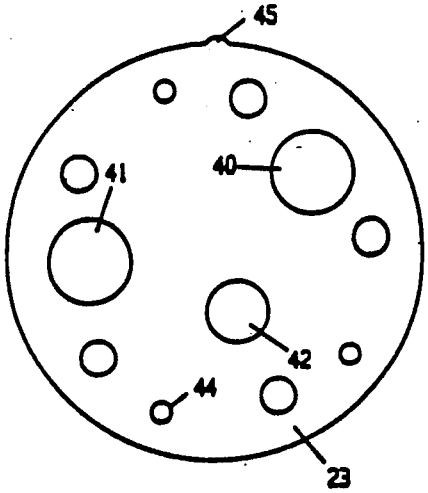
Figure 4:
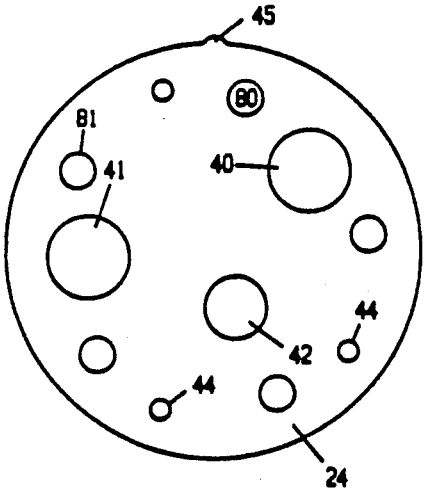
Figure 5:
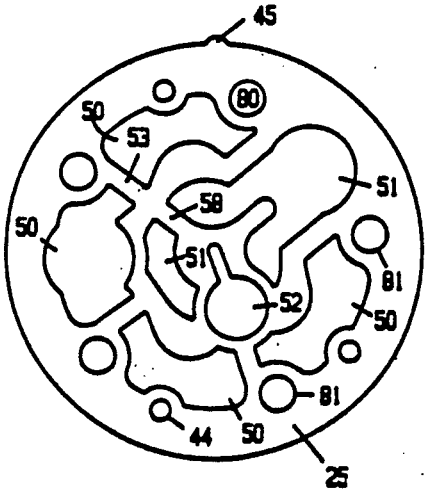
Figure 6:
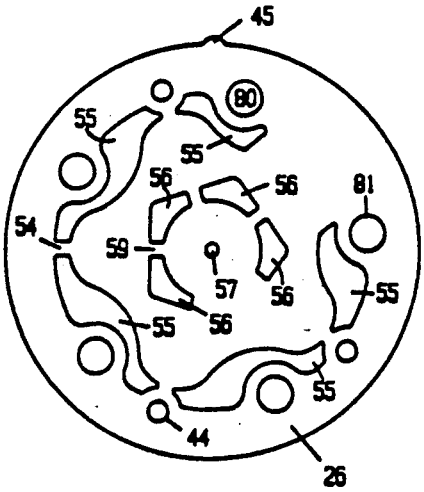

Therefore, although the invention has been described in its preferred form with a certain degree of particularity it is to be understood that numerous changes can be made without parting from the invention as hereinafter claimed. For example the inner valve openings 61 shown are four discreet holes located at the operative positions necessary for inner valving openings. If desired a groove could be cut on the face of the valve 60 interconnecting these holes (in a pattern recognizing the cooperation with the holes 70 to valve the device). One such groove 60 is shown in dotted lines in FIG. 14. This groove would allow fluid to pass on both sides of the valve to the operative opening(s). Other modifications could also be made.

What is claimed:

1. In a gerotor hydraulic pressure device having a wobble stick with integral teeth having an outer diameter directly drivingly engaging a rotor having rotor lobes with a minor diameter, the improvement of the teeth of the wobble stick being laid out in the pattern of the lobes of the rotor and the outer diameter of the integral teeth of the wobble stick being larger than the minor diameter of the rotor lobes.

2. In a gerotor hydraulic pressure device having a wobble stick with teeth having an outside diameter drivingly engaging a rotor having lobes with a minor diameter, the improvement of the outside diameter of the wobble stick teeth being at least equal to the minor diameter of the rotor lobes.

3. In a gerotor hydraulic pressure device having bi-directional valving openings in the body of the device adjacent to a rotor cavity and a wobble stick driven rotor, the valving openings extending about a center of a stator and having an inner edge and the wobble stick having teeth which trace a pattern on the surface containing the valving openings, the pattern having an outside diameter having a distance from the center of the stator, the improvement of the inner edge of the cell openings being within the distance of the outside diameter of the pattern, the inner edge of the cell openings having a recessed shape so as to avoid the areas traced by the teeth of the wobble stick so as to allow a clearance for such teeth.

4. In a gerotor hydraulic pressure device having bolts, a wobble stick having a toe, and a wobble stick toe driven valve orbiting in an opening, the valve having an outer circumference tracing a pattern on the device which pattern extends for a distance from the center of the device, the improvement comprising the bolts protruding into the opening to within the distance of the pattern, the valve being connected to the wobble stick toe for rotation therewith, crescent openings, and said crescent openings being in the outer circumference of the valve allowing clearance for the bolts.

5. In a gerotor device having a body with bi-directional alternately pressurized passages, a rotor forming pressure cells in the body of the device, and closed center orbiting valve with a valve drive opening that sweeps a location on the body of the device, the valve being distinct from the rotor, the improvement of a hole, said hole being in the body of the device, a case drain, said case drain being in the body of the device, said hole being located in the location swept by the valve drive opening so as to interconnect thereto, and said hole interconnecting the isolated center case of the gerotor device to said case drain through the valve drive opening to allow cooling and lubrication fluid to pass therethrough.

6. In a gerotor device having a case, a rotor forming pressure cells in the case of the device, an orbiting valve providing closed center valving, the orbiting valve being distinct from the rotor, an opening running straight through the axial center of the orbiting valve, an improved case drain comprising means to drain the case, said means to drain the case including the opening in the valve.

7. In a gerotor motor having an orbiting valve connected to a valve drive member for rotation therewith, which valve has openings cooperating with bi-directional valving openings in the body of the gerotor motor to selectively connect the pressure cells of the gerotor motor to two fluid connections in the body of the gerotor motor, the valving openings being of a certain number and the valve having a number of null positions per each revolution of the valve wherein a particular valving opening is closed by the valve and not interconnected to the openings of the valve, the improvement of the valve having a number of null positions different than one less than the number of valving openings.

8. The gerotor motor of claim 7 characterized in that the number of null positions is twice one less than the number of valving openings.

9. The gerotor motor of claim 7 wherein the valve has an outer surface and the null positions are located about the circumference of the valve, and characterized in that the outer surface of said valve has recessed notches between the locations of adjoining pairs of null positions.

10. The gerotor motor of claim 9 wherein the body of the gerotor motor has protrusions within the arc swung by the orbiting valve and characterized in that said recessed notches allow clearance for such protrusions.

11. The gerotor motor of claim 7 characterized in that the null positions have a length in a diagonal direction, the valving opening used with the valve and having a diagonal size and said length in the diagonal direction of the null positions being greater than said diagonal size of the valving opening so as to equalize radial and diagonal sealing time.

12. The gerotor motor of claim 8 wherein a valve body separates inner and outer openings in the valve, the inner opening connected to one fluid connection and the outer opening connected to the other fluid connection, the inner and outer openings in the valve for use with the valving openings in the body of the device for valving the device, the valving openings having a certain size in a radial direction in respect to the central longitudinal axis of the motor, the valve body having an outer circumference, the inner openings in the valve being located between pairs of adjoining null positions, and characterized by the addition of an outermost extension to the inner openings in the valve and said outermost extension extending in the valve body towards the outer circumference of the valve in the valve such that the spacing between said outermost extension and such outer opening is less than the radial size of the valving openings.

13. The gerotor motor of claim 7 wherein the orbiting valve has an axis and characterized the null positions are spaced from the axis of the orbiting valve by substantially the same distance.

14. The gerotor motor of claim 7 characterized in that the orbiting valve has an axis and said null positions are located between the inner and outer valve openings which are spaced differing distances from the axis of the valve.

15. The gerotor motor of claim 14 wherein the null positions are symmetrically located in respect to the inner and outer valve openings.

16. The gerotor motor of claim 7 wherein a bidirectional valving opening traces a path on the orbiting valve during the operation of the gerotor motor and characterized in that the path traced is a series of uniform arcs.

17. The gerotor motor of claim 16 characterized in that said series of arcs terminates in a series of single inward positions.

18. The gerotor motor of claim 17 characterized in that said series of single inward positions is located symmetrically in respect to the null positions.

19. The gerotor motor of claim 17 characterized in that said series of single inward positions is substantially centered between adjoining null positions.

20. The gerotor motor of claim 19 wherein the orbiting valve has an axis and characterized the null positions are spaced from the axis of the orbiting valve by substantially the same distance.

21. In a gerotor motor having a body, valving openings in the body of the gerotor motor, an orbiting valve for use with two fluid connections interconnected to a valve drive member for rotation therewith, the orbiting valve having circumferentially spaced inner and outer openings, the inner opening connected to one fluid connection and the outer valving opening connected to the other fluid connection, the orbiting valve having null positions wherein a particular valving opening is closed by the valve and not interconnected to either the inner or outer openings, the null positions being at certain locations on the orbiting valve, the improvement of the number of null positions being twice one less than the number of valving openings, each inner opening having a corresponding leading and lagging outer edge, and the orbiting valve having two null positions for each inner opening, one null position being located between such inner opening and the leading outer edge and the other null position being located between such inner opening and the lagging outer edge.

22. The gerotor motor of claim 21 wherein the valve has an outer surface and characterized in that the outer surface of said valve has recessed notches between adjoining pairs of null positions.

23. The gerotor motor of claim 22 wherein the body of the gerotor motor has protrusions within the arc swung by the orbiting valve and characterized in that said recessed notches allow clearance for such protrusions.

24. The gerotor motor of claim 21 characterized in that the null positions have a length in a diagonal direction, the valving opening used with the valve and having a diagonal size and said length in the diagonal direction of the null positions being greater than said diagonal size of the valving opening so as to equalize radial and diagonal sealing time.

25. The gerotor motor of claim 21 wherein a valve body separates inner and outer openings in the valve for use with the valving openings in the body of the device, the valving openings having a certain size in a radial direction in respect to the central longitudinal axis of the motor, the valve body having an outer circumference, the inner openings in the valve being located between pairs of adjoining null positions, and characterized by the addition of an outermost extension to the inner openings in the valve and said outermost extension extending in the valve body towards the outer circumference of the valve in the valve such that the spacing between said outermost extension and such outer opening is less than the radial size of the valving openings.

26. The gerotor motor of claim 21 wherein the orbiting valve has an axis and characterized the null positions are spaced from the axis of the orbiting valve by substantially the same distance.

27. The gerotor motor of claim 21 characterized in that the orbiting valve has an axis and said null positions are located between the inner and outer valve openings which are spaced differing distances from the axis of the valve.

28. The gerotor motor of claim 21 wherein a valving opening traces a path on the orbiting valve during the operation of the gerotor motor and characterized in that the path traced is a series of uniform arcs terminating in a series of single inward positions.

29. The gerotor motor of claim 28 characterized in that said series of single inward positions is located symmetrically in respect to the null positions.

30. The gerotor motor of claim 28 characterized in that said series of single inward positions is substantially centered between adjoining null positions.

31. In a gerotor motor having a valving opening in the body of the gerotor motor and an orbiting moving valve rotatively affixed to a valve drive member, which valving opening traces a path on such moving valve during the operation of the gerotor motor, the orbiting moving valve having openings and null positions wherein a particular valving opening is closed by the valve and not interconnected to the openings of the orbiting moving valve, the improvement of the path the valving opening traces being a series of uniform arcs terminating substantially in a series of single inward positions, said inward positions being symmetrically located in respect to the orbiting moving valve, and the number of said series of single inward positions being different than the number of null positions.

32. The gerotor motor of claim 31 wherein the valving opening has a certain size in a radial direction in respect to the longitudinal axis of the motor and the orbiting valve has inner and outer openings being radially spaced by a certain distance between the radially outer edge of the inner opening and the radially inner edge of the outer opening and characterized in that the certain distance is less than the certain size.

33. The gerotor motor of claim 32 wherein the orbiting valve has an outer circumference and characterized in that the outer circumference of the orbiting valve is notched between null positions at the locations of the outer opening so as to improve the valving of the outermost openings.

34. In a gerotor motor having a valving opening in the body of the gerotor motor and an orbiting moving valve rotatively affixed to a valve drive member, which valving opening traces a path on such moving valve during the operation of the gerotor motor, the improvement of the valving opening tracing a series of uniform arcs terminating in substantially a series of single inward positions, the orbiting valve having two adjoining null positions in respect to each valve opening wherein the valve opening is closed by the valve and said two null positions being on either side of each said single inward position.

35. The gerotor motor of claim 34 wherein the valve has an outer surface and characterized in that the outer surface of said valve has recessed notches between adjoining pairs of null positions.

36. The gerotor motor of claim 35 wherein the body of the gerotor motor has protrusions within the arc swung by the orbiting valve and characterized in that said recessed notches allow clearance for such protrusions.

37. The gerotor motor of claim 34 characterized in that the null positions have a length in a diagonal direction, the valving opening used with the valve and having a diagonal size and said length in the diagonal direction of the null positions being greater than said diagonal size of the valving opening so as to equalize radial and diagonal sealing time.

38. The gerotor motor of claim 34 wherein the orbiting valve has an axis and characterized in that said two null positions are spaced from the axis of the orbiting valve by substantially the same distance.

39. The gerotor motor of claim 34 wherein the orbiting valve has inner and outer valve openings for use with two fluid connections, the inner opening being connected to one fluid connection and the outer opening connected to the other fluid connection, and the orbiting valve having an axis with the inner and outer valve openings spaced differing distances from the axis of the valve.

40. The gerotor motor of claim 34 wherein the orbiting valve has valve openings and said two null positions are symmetrically located in respect to the valve openings.

41. The gerotor motor of claim 34 characterized in that said series of single inward positions is symmetrically located in respect to said two null positions.

42. The gerotor motor of claim 41 characterized in that said series of single inward positions is substantially centered between adjoining null positions.

43. The gerotor motor of claim 34 characterized by the addition of a manifold, said manifold forming part of the body of the gerotor motor between the orbiting moving valve and the gerotor structure, and the valving openings being in said manifold.

44. In a gerotor motor having a body, an orbiting valve rotatively connected to a valve drive member, which valve cooperates with valving openings in the body of the gerotor motor to selectively connect the pressure cells of the gerotor motor to two fluid connections in the body of the gerotor motor, such valve having alternating inner and outer openings each extending a circumferential angle about the orbiting valve, the inner opening connected to one fluid connection and the outer opening connected to the other fluid connection, the improvement of the circumferential angular extension of each of the inner openings being different than the circumferential angular extension of each of the outer openings.

45. The gerotor motor of claim 44 characterized in that the circumferential angular extensions of each of the inner and outer openings is such so as to substantially equalize the length of time each is connected to each valving opening.

46. In a gerotor motor having a body, valving openings in the body of the gerotor motor, an orbiting valve interconnected to a valve drive member for rotation therewith, the orbiting valve having spaced inner and outer openings connected to two fluid connections respectfully and null positions wherein a particular valving opening is closed by the valve and not interconnected to either the inner or outer openings, the null positions being at certain locations on the orbiting valve, the radially outer edge of the inner opening and the radially inner edge of the outer opening being radially spaced from the center of the orbiting valve by a certain respective distance, the improvement of the certain distance of the radially outer edge of the inner opening being greater than the certain distance of the radially inner edge of the outer opening of the valve and the null positions being symmetrically located in respect to the inner and outer openings.

47. The gerotor motor of claim 46 wherein the orbiting valve has an outer circumference and characterized in that the outer circumference of the orbiting valve is notched between null positions at the locations of the outer opening so as to improve the valving of the outermost openings.

* * * * *